US008220278B2

(12) United States Patent
Han et al.

(10) Patent No.: US 8,220,278 B2
(45) Date of Patent: Jul. 17, 2012

(54) AIR CONDITIONER AND TEMPERATURE SENSOR

(75) Inventors: Seong Joo Han, Yongin-si (KR); Su Ho Jo, Seongnam-si (KR); Sung Hoon Kim, Suwon-si (KR); Jeong Su Han, Suwon-si (KR); Hyen Young Choi, Suwon-si (KR); Sang Jun Lee, Suwon-si (KR); O Do Ryu, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 724 days.

(21) Appl. No.: 12/379,689

(22) Filed: Feb. 26, 2009

(65) Prior Publication Data

US 2009/0232182 A1 Sep. 17, 2009

(30) Foreign Application Priority Data

Mar. 11, 2008 (KR) ..... 10-2008-0022403

(51) Int. Cl.
*F25B 49/00* (2006.01)
*G01K 13/00* (2006.01)

(52) U.S. Cl. ..... 62/126; 62/129; 236/51; 165/237; 374/141

(58) Field of Classification Search ..... 62/126, 62/127, 129; 236/51; 165/237; 374/141
See application file for complete search history.

(56) References Cited

U.S. PATENT DOCUMENTS

| | | | | |
|---|---|---|---|---|
| 5,085,525 | A * | 2/1992 | Bartosiak et al. | 374/124 |
| 5,331,825 | A * | 7/1994 | Kim | 62/180 |
| 6,189,799 | B1 * | 2/2001 | Parker et al. | 236/51 |
| 2009/0230307 | A1 * | 9/2009 | Han et al. | 250/342 |
| 2010/0138048 | A1 * | 6/2010 | Park et al. | 700/276 |
| 2010/0168921 | A1 * | 7/2010 | Park et al. | 700/276 |

FOREIGN PATENT DOCUMENTS

KR 100151302 6/1998

* cited by examiner

*Primary Examiner* — Marc Norman
(74) *Attorney, Agent, or Firm* — Staas & Halsey LLP

(57) ABSTRACT

Disclosed is an air conditioner, in which, when a temperature sensor is rotated, the rotating speed of the temperature sensor is increased or the temperature sensing cycle is elongated in a rotating section where an object does not exist rather than in a rotating section where the object exists. Further, the rotating speed of the temperature sensor is increased or the temperature sensing cycle is elongated if the object is located at a short distance from the air conditioner rather than if the object is located at a normal distance from the air conditioner, and the rotating speed of the temperature sensor is decreased or the temperature sensing cycle is shortened if the object is located at a long distance from the air conditioner rather than if the object is located at a normal distance from the air conditioner.

14 Claims, 10 Drawing Sheets

AIR CONDITIONER AND TEMPERATURE SENSOR

CROSS-REFERENCE TO RELATED APPLICATIONS

This application claims the benefit of Korean Patent Application No. 2008-0022403, filed on Mar. 11, 2008, in the Korean Intellectual Property Office, the disclosure of which is incorporated herein by reference.

BACKGROUND

1. Field

The present invention relates to an air conditioner, and more particularly to an air conditioner, which has a temperature sensor rotated in an indoor space to sense the temperature of the indoor space, and which checks for the existence of a human body using the temperature sensor to control the air-conditioning of the indoor space.

2. Description of the Related Art

In general, air conditioners are apparatuses that cool or heat the environment using an endothermic reaction and an exothermic reaction achieved by evaporating or liquefying a refrigerant circulated in a refrigerating cycle forming a closed circuit by connecting a compressor, a 4-way valve, an outdoor heat exchanger, an outdoor expansion device, an indoor heat exchanger, and an indoor expansion device with refrigerant pipes.

These air conditioners are divided into a ceiling type air conditioner, a wall-mounted type air conditioner, and a stand type air conditioner according to installation methods.

Generally, an air conditioner includes a temperature sensor, which is referred to as a thermopile, rotated by a motor. The air conditioner checks for the existence of a human body by sensing temperatures of respective rotating sections with the temperature sensor rotated by the motor, and controls the direction and amount of air according to results obtained by the check, thus cooling and heating an indoor space in a user's desired optimum state.

A single channel heat sensor having one temperature sensing element or a multi-channel heat sensor having multiple temperature sensing elements disposed in different directions is used as the temperature sensor. In the case that the single channel heat sensor is installed in the air conditioner, when the motor is rotated at a regular speed and thus the sensor is rotated at the regular speed, a microcomputer periodically reads temperature distributions of the respective rotating sections of the indoor space through the temperature sensing element, stores the read temperature distributions in a memory, and checks for the existence of a human body in the corresponding rotating sections based on the stored data. Further, in the case that the multi-channel heat sensor is installed in the air conditioner, when the motor is rotated at a regular speed and thus the sensor is rotated at the regular speed, the microcomputer periodically reads temperature distributions of the respective rotating sections of the indoor space through the temperature sensing elements of the respective channels, stores the read temperature distributions in the memory, and checks for the existence of a human body in the corresponding rotating sections based on the stored data.

In order to enhance the sensing performance of the temperature sensor according to the installation method of the air conditioner, a rotating speed of the temperature sensor or a temperature sensing cycle in the rotating sections of the temperature sensor needs to be changed. That is, the rotating speed of the temperature sensor is increased or the temperature sensing cycle is elongated in a section without a target object, such as a human body or a heat source, in order to increase the temperature sensing speed of the temperature sensor, and the rotating speed of the temperature sensor is decreased or the temperature sensing cycle is shortened in a section with a target object in order to precisely sense the temperature of the indoor space in the section.

However, in the conventional air conditioner, the rotating speed of the temperature sensor and the temperature sensing cycle of the microcomputer are fixed, and thus the temperature sensing intervals of the respective rotating sections are uniform. Therefore, the rotating speed is slow or the temperature sensing cycle is short in a section without a target object and thus the temperature sensing speed may be slow, and the rotating speed of the temperature sensor is fast or the temperature sensing cycle is long in a section with a target object. Thus the sensing of the temperature may not be precisely performed.

Further, in the conventional air conditioner, the rotating speed of the temperature sensor and the temperature sensing cycle of the microcomputer are fixed regardless of the short or long distance of a target object from the air conditioner, and thus the temperature sensing intervals in the respective rotating sections are uniform. Therefore, when the target object is located at a position close to the air conditioner, the rotating speed is slow or the temperature sensing cycle is short, and much data are redundantly sensed at a high speed. Thus the storing and calculating capacity of the microcomputer processing the temperature data may be insufficient. When the target object is located at a position distant from the air conditioner, the rotating speed is fast or the temperature sensing cycle is long, and the collection of data is insufficient. Thus the temperature sensing may not be performed precisely. Particularly, in the case that the multi-channel heat sensor collecting data through respective channels is employed, the above problem may be more severe.

SUMMARY

Therefore, one aspect of the embodiments is to provide an air conditioner, in which a rotating speed of a temperature sensor or a temperature sensing cycle is changed according to characteristics of respective rotating sections in which the temperature sensor is rotated, and thus has an enhanced temperature sensing performance in an indoor space.

Additional aspects and/or advantages will be set forth in part in the description which follows and, in part, will be apparent from the description, or may be learned by practice of the invention.

The foregoing and/or other aspects are achieved by providing an air conditioner including a temperature sensing unit sensing a temperature of an indoor space; a rotating unit rotating the temperature sensing unit to a plurality of rotating sections; and a control unit changing a rotating speed or a temperature sensing cycle of the temperature sensing unit according to the respective rotating sections.

The foregoing and/or other aspects are achieved by providing an air conditioner including a temperature sensing unit sensing a temperature of an indoor space; a distance sensing unit sensing the distance to an object in the indoor space; a rotating unit rotating the temperature sensing unit and the distance sensing unit to a plurality of rotating sections; and a control unit changing a rotating speed or a temperature sensing cycle of the temperature sensing unit based on the distance to the object according to the respective rotating sections.

The foregoing and/or other aspects are achieved by providing an air conditioner including a temperature sensing unit sensing a temperature of an indoor space; a rotating unit rotating the temperature sensing unit to a plurality of rotating sections; and a control unit determining whether or not an object exists in the respective rotating sections through the temperature sensing unit, and changing a rotating speed or a temperature sensing cycle of the temperature sensing unit based on the determination as to whether or not the object exists in the rotating sections.

The foregoing and/or other aspects are achieved by providing an air conditioner including a temperature sensing unit sensing a temperature of an indoor space; a distance sensing unit sensing a distance to an object in the indoor space; a rotating unit rotating the temperature sensing unit and the distance sensing unit; and a control unit changing a rotating speed or a temperature sensing cycle of the temperature sensing unit based on the distance to the object when the object exists in the indoor space.

The foregoing and/or other aspects are achieved by providing an air conditioner including a temperature sensing unit sensing a temperature of an indoor space; a rotating unit rotating the temperature sensing unit; and a control unit controlling the temperature sensing unit and the rotating unit, wherein the temperature sensing unit is a multi-channel heat sensor having a plurality of temperature sensing elements, and the temperature sensing cycles of the temperature sensing unit corresponding to respective channels are predetermined differently.

The foregoing and/or other aspects are achieved by providing a method of controlling an air conditioner, including: sensing a distance to a target object within one of a plurality of rotating sections with a distance sensing unit; determining whether a distance to the target object is greater than or less than a reference distance; and increasing a rotating speed of a temperature sensing unit with respect to a reference speed in the rotating section in which the target object resides when the distance to the target object is less than the reference distance or decreasing the rotating speed of the temperature sensing unit with respect to the reference speed in the rotating section in which the target object resides when the distance to the target object is greater than the reference distance.

The foregoing and/or other aspects are achieved by providing a method of controlling an air conditioner, including: sensing a distance to a target object within one of a plurality of rotating sections with a distance sensing unit; determining whether a distance to the target object is greater than or less than a reference distance; and increasing a temperature sensing cycle of a temperature sensing unit with respect to a reference temperature sensing cycle in the rotating section in which the target object resides when the distance to the target object is less than the reference distance or decreasing the temperature sensing cycle of the temperature sensing unit with respect to the reference temperature sensing cycle in the rotating section in which the target object resides when the distance to the target object is greater than the reference distance.

BRIEF DESCRIPTION OF THE DRAWINGS

These and/or other aspects and advantages will become apparent and more readily appreciated from the following description of the embodiments, taken in conjunction with the accompanying drawings in which.

DETAILED DESCRIPTION OF EMBODIMENTS

Figure 1:
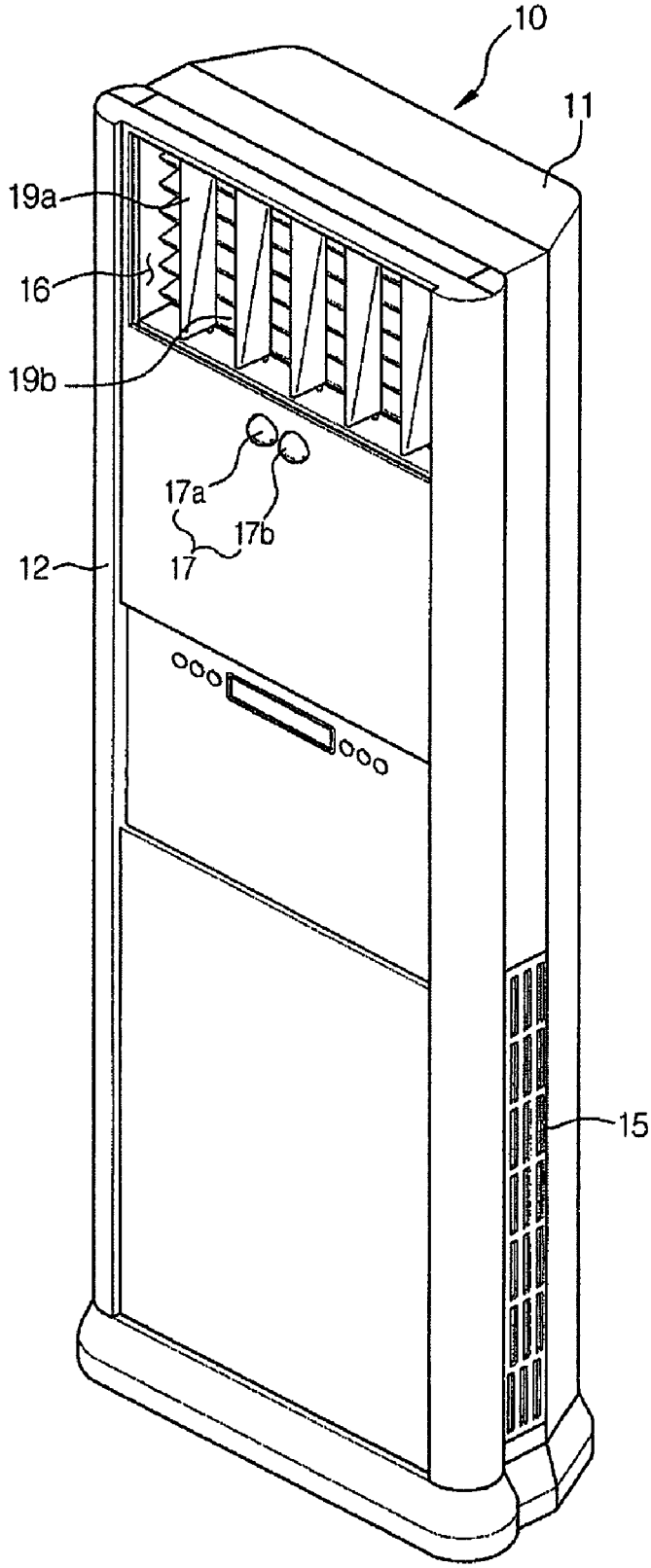
FIG. 1 is a perspective view of an air conditioner in accordance with one embodiment.

Reference will now be made in detail to the embodiments, examples of which are illustrated in the accompanying drawings, where like reference numerals refer to like elements throughout. The embodiments are described below to explain the present invention by referring to the annexed drawings.

Figure 2:
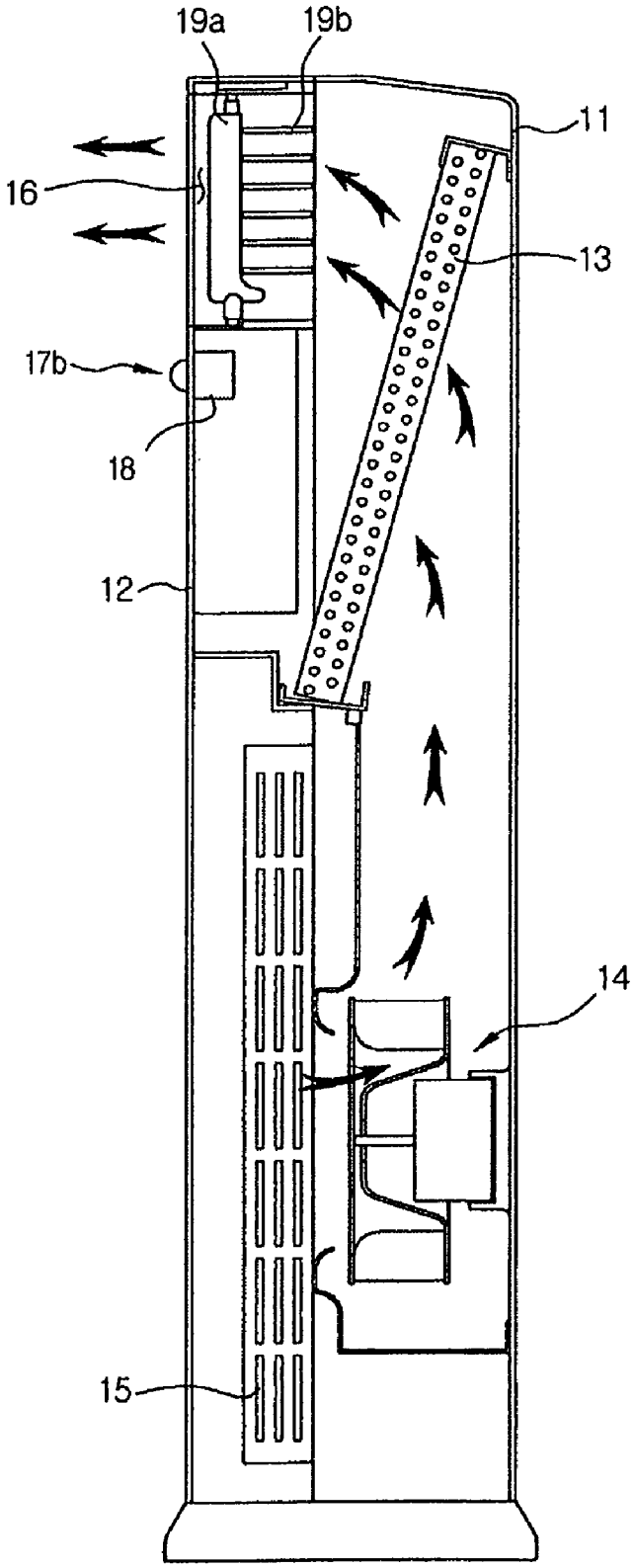
FIG. 2 is a longitudinal-sectional view of the air conditioner in accordance with the embodiment.

An air conditioner in accordance with one embodiment, as shown in FIGS. 1 and 2, includes a main body 10 including a box type cabinet 11 provided with an opened front surface, and a front panel 12 covering the opened front surface of the cabinet 11. A heat exchanger 13 to exchange heat and a blower fan 14 to blow air are provided in the main body 10.

First suction ports 15, through which indoor air is inhaled to the inside of the main body 10, may be respectively formed through both side surfaces of the lower portion of the main body 10, and an exhaust port 16, through which air conditioned in the main body 10 is exhausted again to an indoor space, may be formed through the upper portion of the front panel 12 of the main body 10.

A sensing unit 17 including a distance sensor 17*a* and a temperature sensor 17*b* is installed below the exhaust port 16 such that the distance sensor 17*a* and the temperature sensor 17*b* are rotated to right and left at a designated angle range. The distance sensor 17*a* and the temperature sensor 17*b* are rotated by a motor 18. The distance sensor 17*a* senses a distance to an obstacle located at a position of the indoor space in the rotating direction of the distance sensor 17*a*. The temperature sensor 17*b* senses a temperature of a position within the indoor space in the rotating direction of the temperature sensor 17*b*. Here, the distance sensor 17*a* and the temperature sensor 17*b* may be respectively controlled by motors, which are individually rotated.

Vertical louvers 19*a* to guide the exhausted air right and left and horizontal louvers 19*b* to guide the exhausted air up and down are installed in the exhaust port 16.

The heat exchanger 13 in the main body 10 may be installed in the upper portion of the inside of the main body 10 at a designated angle such that air passing through the heat exchanger 13 can exchange heat with the heat exchanger 13. Further, the blower fan 14 may be installed in the lower portion of the inside of the main body 10, and blows the air inhaled into the main body 10 through both suction ports 15 to the exhaust port 16 through the heat exchanger 13.

The above configuration of the air conditioner causes the air, inhaled to the inside of the main body 10 through the suction ports 15 when the air blower fan 14 is operated, to exchange heat with the heat exchanger 13 in the upper portion of the inside of the main body 10, and then to be supplied again to the indoor space through the exhaust port 16, thus being capable of cooling and heating the indoor air.

Figure 3:
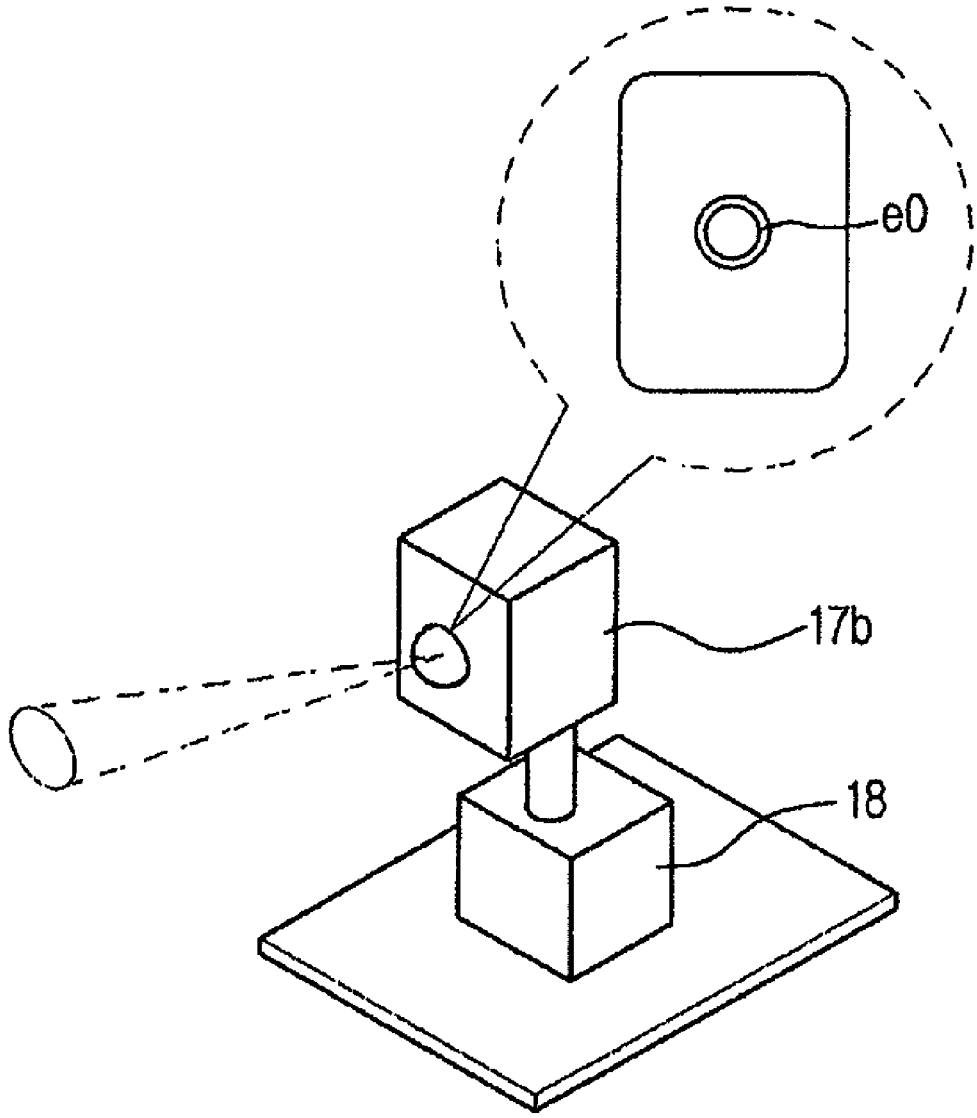
FIG. 3 is a schematic view illustrating a single channel heat sensor, which is used as a temperature sensor of the air conditioner in accordance with the embodiment.

In the case that the temperature sensor 17*b* is a single channel temperature sensor 17*b*, as shown in FIG. 3, the single channel temperature sensor 17*b* includes one temperature sensing element e0. The signal channel temperature sensor 17*b* is rotated right and left by the motor 18. Further, the signal channel temperature sensor 17*b* may also be rotated up and down by another motor provided, as occasion demands.

Figure 4:
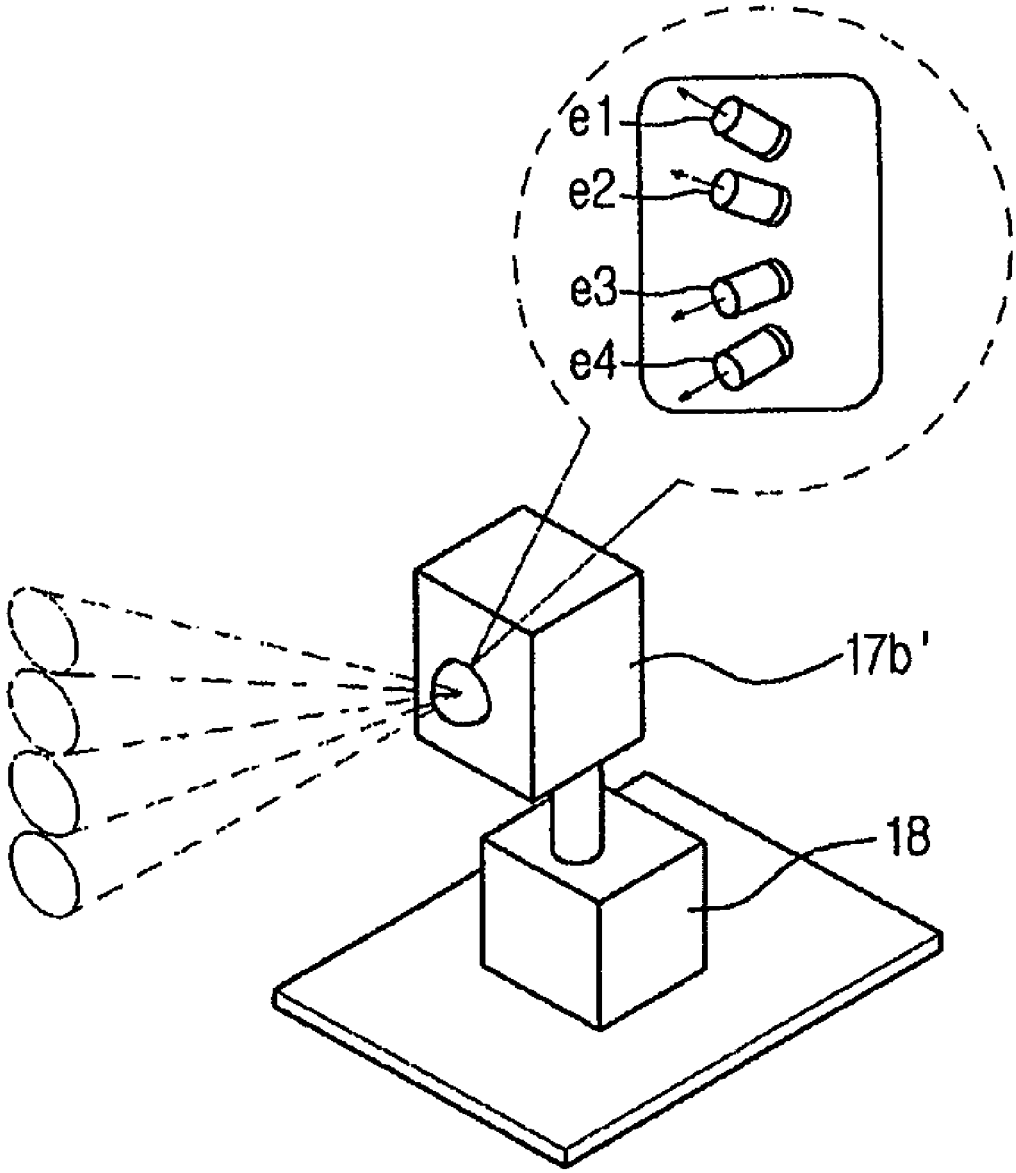
FIG. 4 is a schematic view illustrating a multi-channel heat sensor, which is used as a temperature sensor of the air conditioner in accordance with the embodiment.

Further, in the case that the temperature sensor 17*b* is a multi-channel temperature sensor 17*b*', as shown in FIG. 4, the multi-channel temperature sensor 17*b*' includes a plurality of temperature sensing elements e1 to e4 (for example, four temperature sensing elements). The four temperature sensing elements e1 to e4 are respectively disposed at different directions such that the four temperature sensing elements e1 to e4 sense temperatures of the indoor space in the respective directions. Particularly, the first to fourth temperature sensing elements e1 to e4 may be set in array. The multi-channel temperature sensor 17*b*' is rotated right and left by the motor 18*b*.

The above temperature sensor 17*b* is formed by joining two kinds of metals, and is a thermocouple using an action in that thermoelectromotive force is generated on a closed loop connecting the two kinds of metals, when any one kind of the metals is varied in temperature.

Figure 5:
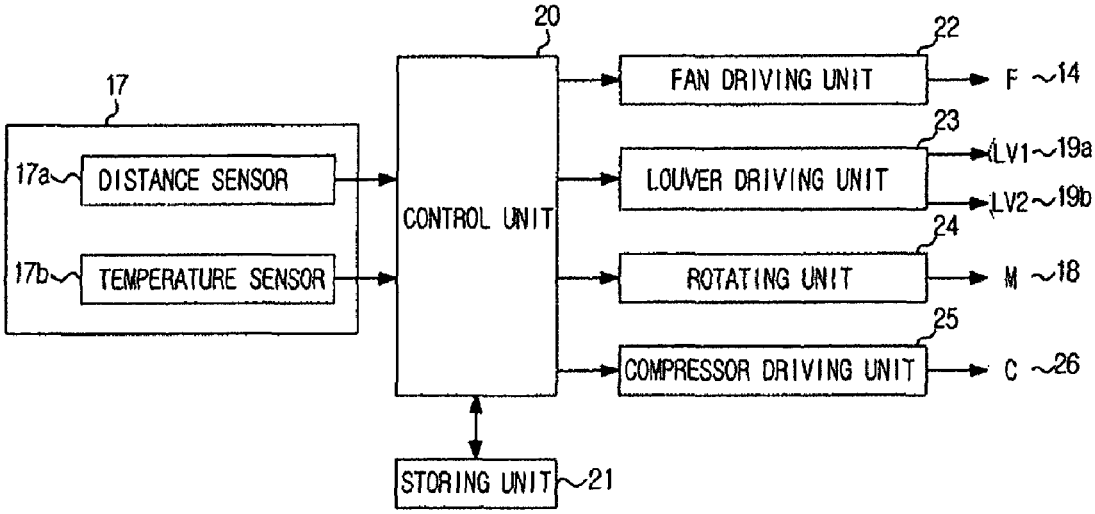
FIG. 5 is a control block diagram of the air conditioner in accordance with the embodiment.

As shown in FIG. 5, the above-described air conditioner in accordance with the embodiment includes a control unit 20 to control the overall operation of the air conditioner.

The sensing unit 17 including the distance sensor 17*a* and the temperature sensor 17*b* is electrically connected to the input side of the control unit 20. The distance sensor 17*a* and the temperature sensor 17*b* are rotated by the motor 18. The distance sensor 17*a* senses a distance to a target object in the indoor space in the rotating direction of the distance sensor 17*a*, and includes a light emitting part and a light receiving part. The distance sensor 17*a* transmits, for example, infrared light to the target object, and senses the distance to the target object according to the arrival time of the infrared light, which is reflected by the target object and returned to the distance sensor 17*a*. The temperature sensor 17*b* senses a temperature of the indoor space in the rotating direction of the temperature sensor 17*b*, and includes a lens, a thermopile, and a signal processor. The temperature sensor 17*b* senses the temperature of the indoor space using a signal output value changed by the temperature of the indoor space.

A fan driving unit 22 to drive the blower fan 14, a louver driving unit 23 to drive the vertical louvers 19*a* and the horizontal louvers 19*b*, a rotating unit 24 to drive the motor 18 rotating the distance sensor 17*a* and the temperature sensor 17*b*, and a compressor driving unit 25 to drive a compressor 26 are electrically connected to the output side of the control unit 20.

Further, a storing unit 21 to sequentially store distance data and temperature data of the respective rotating sections sensed by the distance sensor 17*a* and the temperature sensor 17*b* is electrically connected to the control unit 20.

The control unit 20 rotates the distance sensor 17*a* and the temperature sensor 17*b* through the rotating unit 24, senses distance values with target objects and temperature values of the rotating sections in respective directions at designated intervals during the rotation of the distance sensor 17*a* and the temperature sensor 17*b*, and stores the sensed distance values and temperature values in the storing unit 21 according to the respective rotating sections. In the case that a target object does not exist in a corresponding rotating section, the transmitted infrared light is reflected by the surface of a wall and then returned to the distance sensor 17*a*, and in case that a target object exists in the corresponding rotating section, the transmitted infrared light is reflected by the target object and then returned to the distance sensor 17*a*. Thus, a difference of the returning time of the infrared light occurs according to existence and nonexistence of the target object, and the control unit 20 detects whether or not the target object exists in the corresponding rotating section and the position of the target object, i.e., whether or not the target object in the corresponding rotating section is located at a long distance or a short distance from the air conditioner, based on a change between an earlier distance value and the current distance value.

In the case that a person does not exist in a corresponding rotating section, a low temperature value is sensed, but in the case that a person exists in the corresponding rotating section, a relatively high temperature value is sensed. Particularly, in the case that a heat source other than a person exists in the corresponding rotating section, a higher temperature value is sensed than the temperature value of the rotating section when a heat source that is a person exists in the rotating section. Therefore, the control unit 20 compares the current temperature with the earlier temperature when the person is sensed, and thus determines whether or not a human body exists in a corresponding section. A difference of the sensed temperature values between a human body and a heat source is determined, and thus the human body is easily distinguished from the heat source. Here, the earlier temperature may be a temperature just before the sensing or the mean value of all the former temperatures.

As described above, in the conventional air conditioner, the rotating speed of the temperature sensor and the temperature sensing cycle of the microcomputer are fixed regardless of the short or long distance of a target object from the air conditioner. Therefore, when the target object is located at a short distance from the air conditioner, the rotating speed is slow or the temperature sensing cycle is short, and many data are redundantly sensed at a high speed. Thus, the storing and calculating capacity of the microcomputer processing the temperature data may be insufficient. When the target object is located at a long distance from the air conditioner, the rotating speed is fast or the temperature sensing cycle is long, and the collection of data may be insufficient. Thus the temperature sensing may not be performed precisely.

Figure 6:
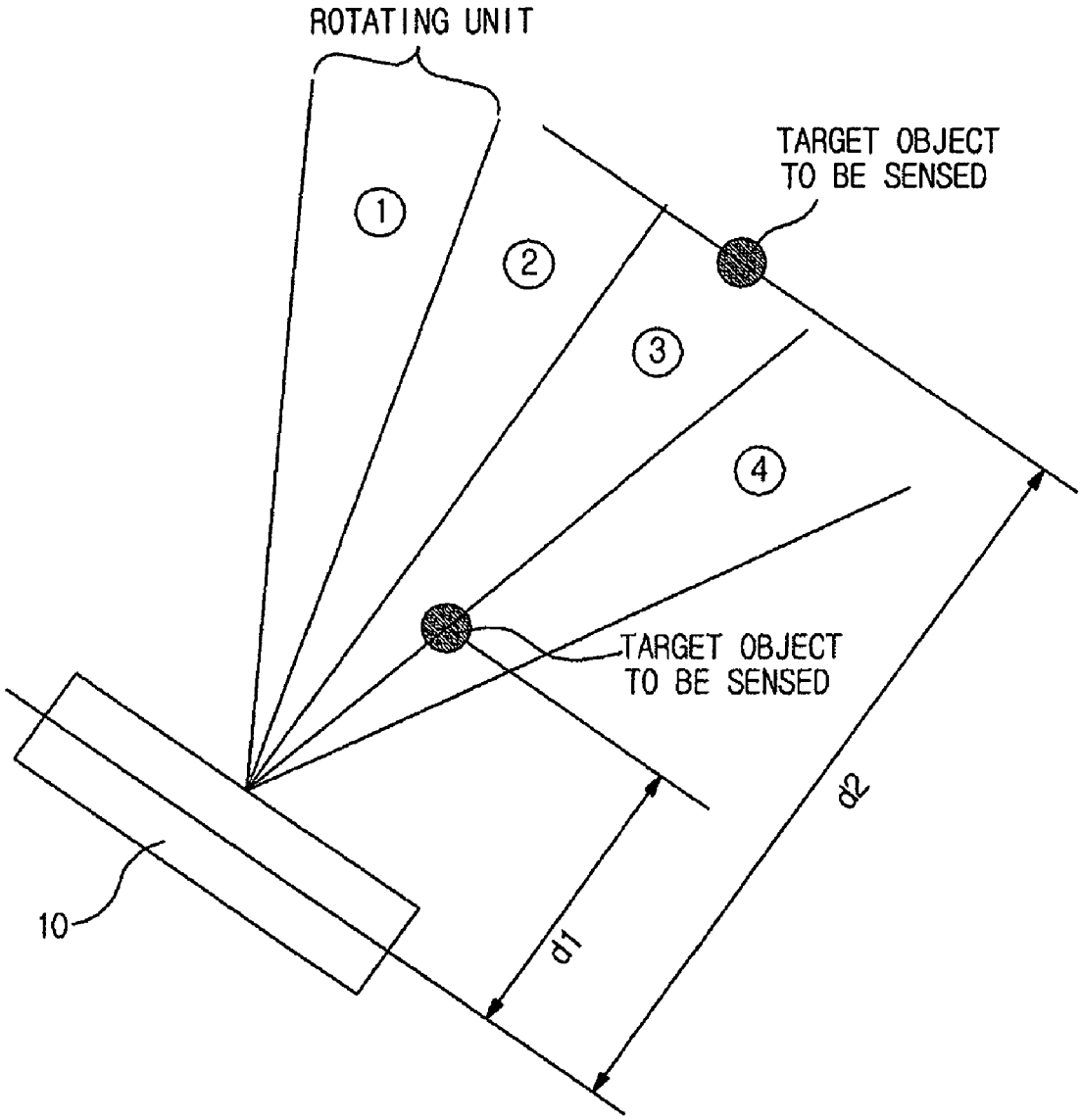
FIG. 6 is a schematic view illustrating target objects to be sensed, which are respectively located at a short distance and a long distance from the air conditioner in accordance with the embodiment.

Therefore, in the air conditioner in accordance with this embodiment, when the temperature sensor is rotated, distances of the indoor space in the respective rotating sections are sensed, whether or not a target object exists in a corresponding rotating section is checked based on the sensed distances, and the rotating speed of the temperature sensor in the corresponding rotating section is increased or the temperature sensing cycle is elongated to shorten the temperature sensing interval, when the target object is located at a short distance from the air conditioner. Further, the rotating speed of the temperature sensor in the corresponding rotating section is decreased or the temperature sensing cycle is shortened to elongate the temperature sensing interval, when the target object is located at a long distance from the air conditioner. Thereby, although a target object is located at a short distance (d1) from the air conditioner, as shown in FIG. 6, the temperature sensing speed is increased and the collection of data is not excessively carried out, and thus the air conditioner needs not employ a microcomputer having an excellent storing and calculating capacity. Further, although a target object is located at a long distance (d2) from the air conditioner, the collection of data is sufficiently carried out, and thus the air conditioner has an improved temperature sensing capacity of the indoor space according to rotating sections. That is, when the target object is located at the short distance (d1) from the air conditioner, the target object can be sensed without being missed even in a sparse scan manner of a type of "(1+2)→(3+4)", and thus the overall regions can be more rapidly sensed. On the other hand, when the target object is located at the long distance (d2) from the air conditioner, the target object cannot be sensed in the sparse scan manner of a type of "(1+2)→(3+4)", and thus is able to be sensed in a dense scan manner of a type of "1→2→3→4".

Hereinafter, methods of controlling the air conditioner in accordance with this embodiment when a single channel heat sensor is used as the temperature sensor 17*b* and when a multi-channel heat sensor is used as the temperature sensor 17*b* will be respectively described. For the convenience of description, the change of the rotating speed of the temperature sensor 17*b* will be described.

Figure 7:
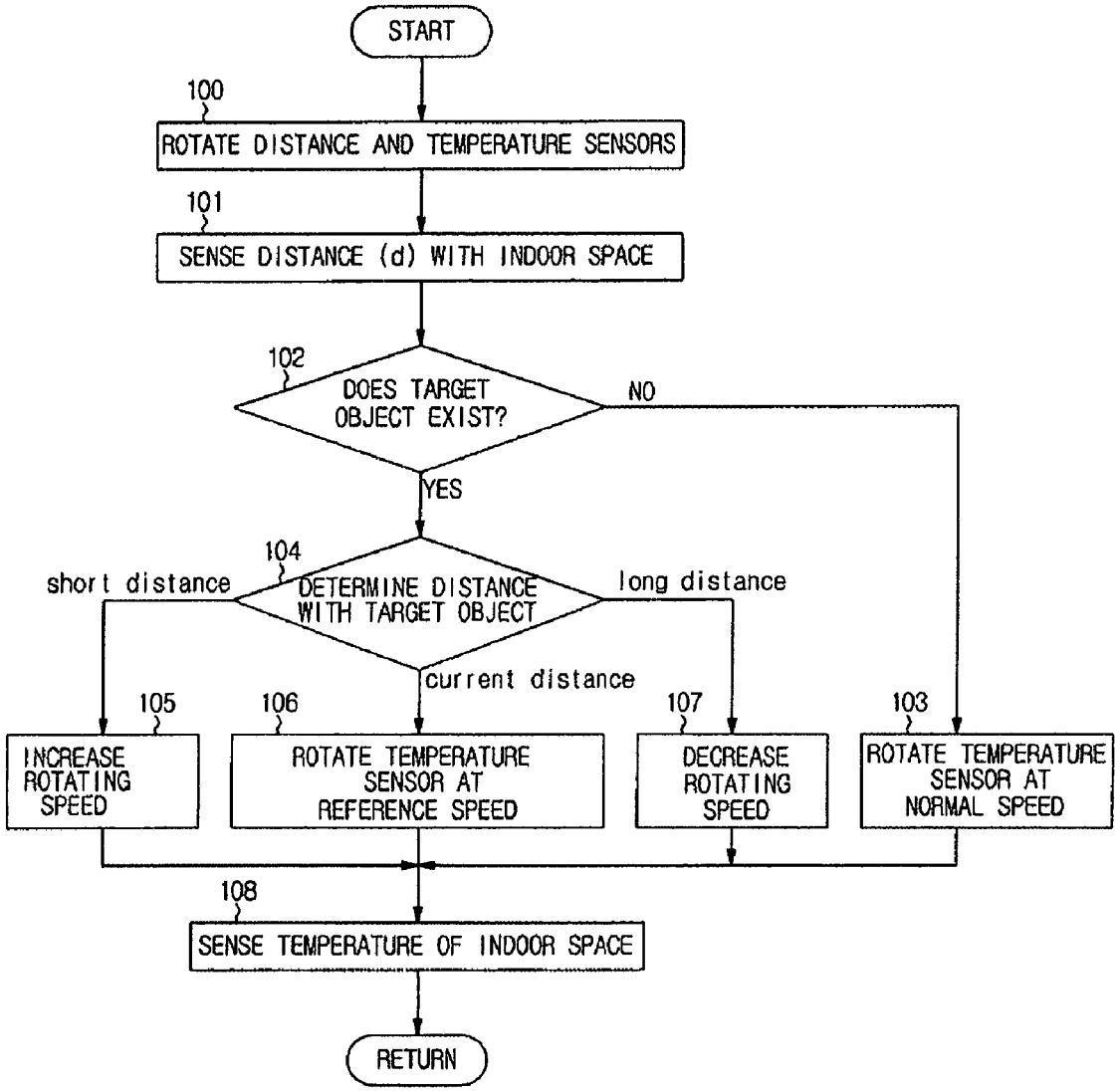
FIG. 7 is a flow chart illustrating a method of controlling the air conditioner in accordance with the embodiment in the case that the single channel heat sensor is used.

When a single channel heat sensor is used as the temperature sensor 17*b*, as shown in FIG. 7, when the air conditioner is installed, the control unit 20 drives the motor 18 through the rotating unit 24 to rotate the distance sensor 17*a* and the temperature sensor 17*b* throughout the overall rotating sections of an indoor space, and senses and stores reference distances within the indoor space in the respective rotating sections through the distance sensor 17*a*. This sensing operation may be performed one time or several times. Such an initial sensing operation may be performed on the condition that a person does not exist in the indoor space.

Thereafter, during the operation of the air conditioner, the control unit 20 drives the motor 18 through the rotating unit 24 to rotate the distance sensor 17*a* and the temperature sensor 17*b* (100). While rotating the distance sensor 17*a* and the temperature sensor 17*b*, the distance sensor 17*a* senses a distance within the indoor space in a rotating section (101).

After the sensing of the distance with the indoor space in the rotating section, the control unit 20 determines whether or not a target object exists in the rotating section by comparing the sensed distance (d) with the reference distance sensed and stored when the air conditioner is installed (102). If it is determined that the target object does not exist in the rotating section, the control unit 20 changes the rotating speed of the temperature sensor 17*b* to a normal rotating speed (103), and the temperature sensor 17*b* is rotated at the normal rotating speed and then senses a temperature of the indoor space in the rotating section (108).

On the other hand, if it is determined that the target object exists in the rotating section, the control unit 20 determines a distance to the target object (104). If the sensed distance (d) is shorter than a predetermined distance, the control unit 20 determines that the target object is located at a short distance from the air conditioner, and increases the rotating speed of the motor 18 so as not to sense unnecessary redundant data (105). Thereby, the temperature sensing interval is elongated and thus the unnecessary redundant data are not sensed. Further, if the sensed distance (d) is equal to the predetermined distance, the control unit 20 determines that the target object is located at a normal distance from the air conditioner, and changes the rotating speed of the motor 18 to a predetermined reference rotating speed (106). Further, if the sensed distance (d) is longer than the predetermined distance, the control unit 20 determines that the target object is located at a long distance from the air conditioner, and decreases the rotating speed of the motor 18 to properly sense the temperature of the indoor space in the rotating section (107). Thereby, the temperature sensing interval in the rotating section is shortened and thus a temperature of the indoor space in the rotating section is exactly sensed.

Thereafter, the temperature sensor 17*b* senses the temperature of the indoor space in the corresponding rotating section (108).

Now, a method of controlling the air conditioner in the case that a multi-channel heat sensor is used as the temperature sensor 17*b* will be respectively described. For the convenience of description, only one channel out of plural channels of the temperature sensor 17*b* will be described.

Figure 8:
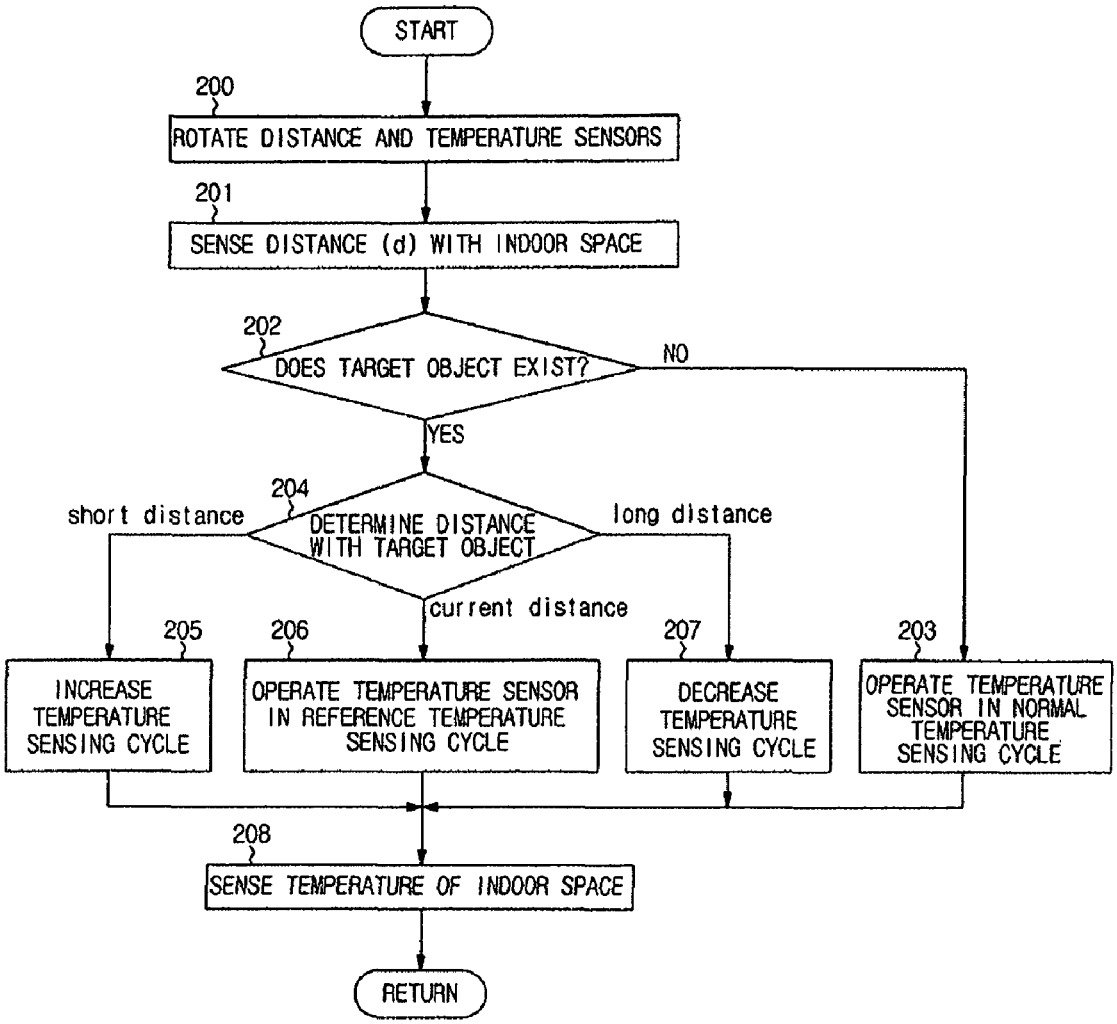
FIG. 8 is a flow chart illustrating a method of controlling the air conditioner in accordance with the embodiment in the case that the multi-channel heat sensor is used.

With reference to FIG. 8, when the air conditioner is installed, the control unit 20 drives the motor 18 through the rotating unit 24 to rotate the distance sensor 17*a* and the temperature sensor 17*b* throughout the overall rotating sections of an indoor space, and senses and stores reference distances with the indoor space in the respective rotating sections through the distance sensor 17*a*. This sensing operation may be performed one time or several times. Such an initial sensing operation may be performed on condition that any person does not exist in the indoor space.

Thereafter, during the operation of the air conditioner, the control unit 20 drives the motor 18 through the rotating unit 24 to rotate the distance sensor 17*a* and the temperature sensor 17*b* (200). While rotating the distance sensor 17*a* and the temperature sensor 17*b*, the distance sensor 17*a* senses a distance with the indoor space in a rotating section (201).

After the sensing of the distance with the indoor space in the rotating section, the control unit 20 determines whether or not a target object exists in the rotating section by comparing the sensed distance (d) with the reference distance sensed and stored when the air conditioner is installed (202). If it is determined that the target object does not exist in the rotating section, the control unit 20 changes the temperature sensing cycle of the temperature sensor 17*b* to a normal temperature sensing cycle (203), and then the temperature sensor 17*b* senses a temperature of the indoor space in the rotating section at the normal temperature sensing cycle (208).

On the other hand, if it is determined that the target object exists in the rotating section, the control unit 20 determines a distance to the target object (204). If the sensed distance (d) is shorter than a predetermined distance, the control unit 20 determines that the target object is located at a short distance from the air conditioner, and increases the temperature sensing cycle so as not to sense unnecessary redundant data (205). Thereby, the temperature sensing interval is elongated and thus the unnecessary redundant data are not sensed. Further, if the sensed distance (d) is equal to the predetermined distance, the control unit 20 determines that the target object is located at a normal distance from the air conditioner, and changes the temperature sensing cycle to a predetermined reference temperature sensing cycle (206). Further, if the sensed distance (d) is longer than the predetermined distance, the control unit 20 determines that the target object is located at a long distance from the air conditioner, and decreases the temperature sensing cycle so as to properly sense a temperature of the indoor space in the rotating section (207). Thereby, the temperature sensing interval in the rotating section is shortened and thus the temperature of the indoor space in the rotating section is exactly sensed.

Thereafter, the temperature sensor 17*b* senses the temperature of the indoor space in the corresponding rotating section (208).

By the above method, the control of the air conditioner through other channels is possible.

Hereinafter, the application of the above control method to an air conditioner with only a temperature sensor without a distance sensor will be described.

Figure 9:
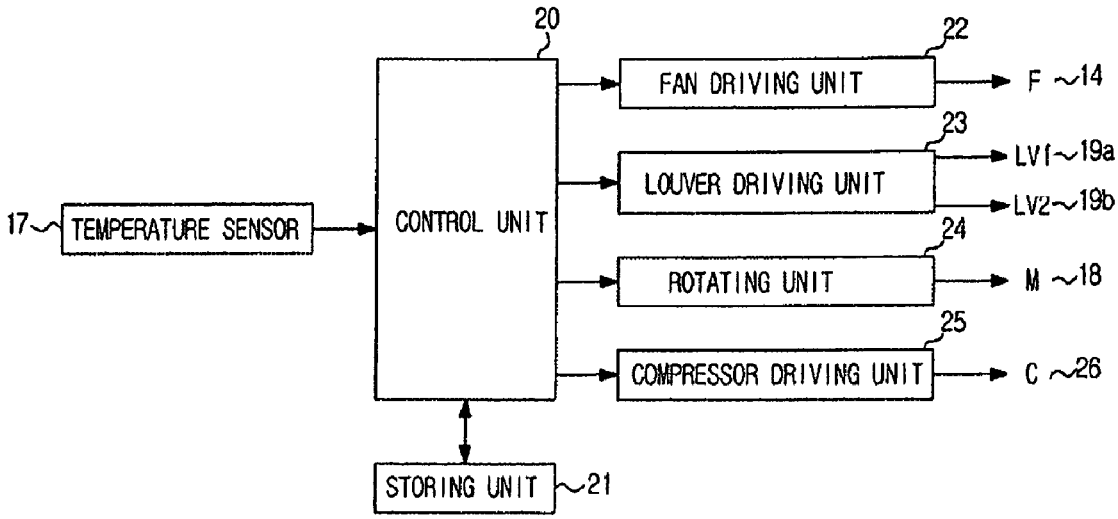
FIG. 9 is a control block diagram of an air conditioner in accordance with another embodiment.

In the case that an air conditioner has only a temperature sensor 17 without a distance sensor, as shown in FIG. 9, the control unit 20 changes the rotating speed or the temperature sensing cycle of the temperature sensor 17 according to respective rotating sections, and thus has the same effect.

First, the rotating speeds or the temperature sensing cycles of the temperature sensor 17 in respective rotating sections are predetermined. Generally, if the temperature sensor 17 is rotated right and left, the closer to the first and final rotating sections the temperature sensor 17 is, the lower the probability that a target object exists, and the closer to the central rotating section the temperature sensor 17 is, the higher the probability that a target object exists. Thus, the temperature sensor 17 is configured such that the rotating speed of the temperature sensor 17 at side rotating sections is higher than that at front rotating sections, or the temperature sensing cycle of the temperature sensor 17 at side rotating sections is longer than that at front rotating sections.

Figure 10:
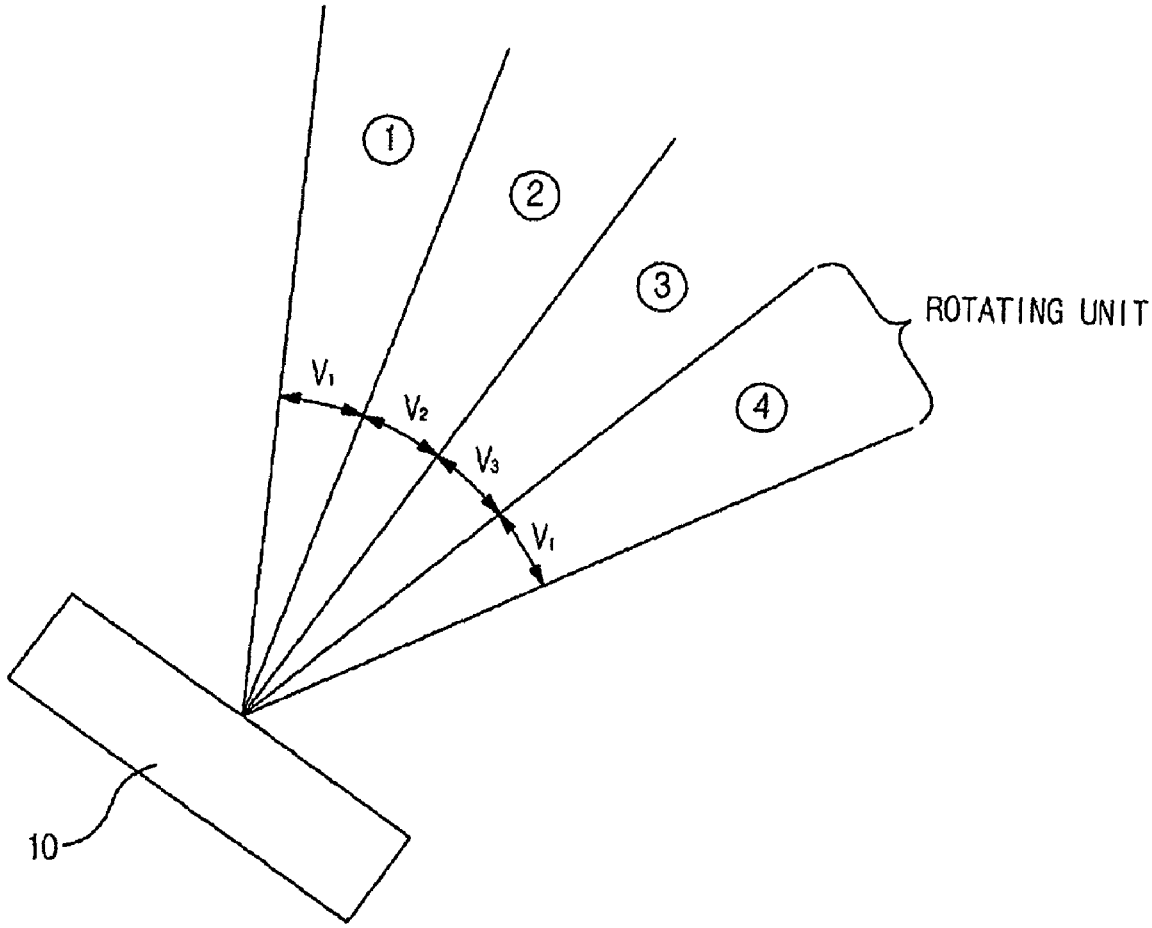
FIG. 10 is a schematic view illustrating a change in a rotating speed corresponding to respective rotating sections in the air conditioner in accordance with this embodiment.

When the temperature sensor 17 is rotated in first to fourth rotating sections, as shown in FIG. 10, the rotating speeds or the temperature sensing cycles of the temperature sensor 17 in the respective rotating sections are changed. That is, in a section having a high probability that a target object does not exist, the rotating speed or the temperature sensing cycle of the temperature sensor 17 is increased or elongated so as not to carry out the excessive collection of data, and thus the temperature sensing speed is increased and the air conditioner needs not employ a microcomputer having an excellent storing and calculating capacity. Further, in a section having a high probability that a target object exists, the rotating speed or the temperature sensing cycle of the temperature sensor 17 is decreased or shortened and the collection of data is sufficiently carried out, even when the target object is located at a long distance from the air conditioner, and thus the air conditioner has an improved temperature sensing capacity of an indoor space.

On the other hand, if a multi-channel heat sensor having several temperature sensing elements is used as the temperature sensor 17, instead of the method in which the rotating speeds or the temperature sensing cycles of the temperature sensor 17 in respective rotating sections are differently predetermined, the temperature sensing cycles of the temperature sensor 17 in respective channels may be differently predetermined and the temperatures of the indoor space in respective sections may be sensed according to the temperature sensing cycles of the temperature sensor 17 in the respective channels.

As apparent from the above description, in the air conditioner of the present embodiments, when the temperature sensor is rotated, the rotating speed of the temperature sensor is increased or the temperature sensing cycle is elongated in a rotating section where an object does not exist rather than in a rotating section where the object exists. Further, the rotating speed of the temperature sensor is increased or the temperature sensing cycle is elongated when the object is located at a short distance from the air conditioner rather than when the object is located at a normal distance from the air conditioner, and the rotating speed of the temperature sensor is decreased or the temperature sensing cycle is shortened when the object is located at a long distance from the air conditioner rather than when the object is located at a normal distance from the air conditioner. Thereby, in the case that an object does not exist or an object is located at the short distance from the air conditioner, the excessive collection of data is not carried out, the temperature sensing speed is increased and the air conditioner needs not employ a microcomputer having an excellent storing and calculating capacity, and in case that an object exists or an object is located at the long distance from the air conditioner, the collection of data is sufficiently carried out and the air conditioner has an improved temperature sensing capacity of an indoor space.

Although embodiments have been shown and described, it would be appreciated by those skilled in the art that changes may be made in these embodiments without departing from the principles and spirit of the invention, the scope of which is defined in the claims and their equivalents.

What is claimed is:

1. An air conditioner, comprising:

a temperature sensing unit to sense a temperature of an indoor space;

a rotating unit to rotate the temperature sensing unit to a plurality of rotating sections; and a control unit to change a rotating speed or a temperature sensing cycle of the temperature sensing unit according to the sensed results within respective rotating sections.

2. The air conditioner according to claim 1, wherein the rotating speeds or the temperature sensing cycles of the temperature sensing unit in the respective rotating sections are predetermined.

3. The air conditioner according to claim 1, wherein the temperature sensing unit is a multi-channel heat sensor having a plurality of temperature sensing elements, and the control unit changes the temperature sensing cycle of the temperature sensing unit corresponding to channels according to the respective rotating sections.

4. An air conditioner, comprising:

a temperature sensing unit to sense a temperature of an indoor space;

a distance sensing unit to sense a distance to an object in the indoor space;

a rotating unit to rotate the temperature sensing unit and the distance sensing unit to a plurality of rotating sections; and a control unit to change a rotating speed or a temperature sensing cycle of the temperature sensing unit based on the sensed distance to the object according to the respective rotating sections.

5. The air conditioner according to claim 4, wherein the control unit determines whether or not the object exists in a corresponding rotating section according to the respective rotating sections, and changes the rotating speed or the temperature sensing cycle based on the distance to the object when the object exists in the corresponding rotating section.

6. The air conditioner according to claim 5, wherein the shorter the distance to the object, the more the control unit increases the rotating speed or elongates the temperature sensing cycle, and the longer the distance to the object, the more the control unit decreases the rotating speed or shortens the temperature sensing cycle.

7. The air conditioner according to claim 4, wherein the temperature sensing unit is a multi-channel heat sensor having a plurality of temperature sensing elements, and the control unit changes the temperature sensing cycle of the temperature sensing unit corresponding to channels according to the respective rotating sections.

8. An air conditioner, comprising:

a temperature sensing unit to sense a temperature of an indoor space;

a rotating unit to rotate the temperature sensing unit to a plurality of rotating sections; and a control unit to determine whether or not an object exists in the respective rotating sections through the temperature sensing unit, and changing a rotating speed or a temperature sensing cycle of the temperature sensing unit based the determination as to whether or not the object exists in the rotating sections.

9. The air conditioner according to claim 8, wherein the control unit increases the rotating speed of the temperature sensing unit or elongates the temperature sensing cycle in a rotating section in which the object does not exist and does not increase the rotating speed or elongate the temperature sensing cycle in a rotating section in which the object exists.

10. An air conditioner, comprising:

a temperature sensing unit to sense a temperature of an indoor space;

a distance sensing unit to sense a distance to an object in the indoor space;

a rotating unit to rotate the temperature sensing unit and the distance sensing unit; and a control unit to change a rotating speed or a temperature sensing cycle of the temperature sensing unit based on the sensed distance to the object when the object exists in the indoor space.

11. The air conditioner according to claim 10, wherein shorter the distance to the object, the more the control unit increases the rotating speed or elongates the temperature sensing cycle, and the longer the distance to the object, the more the control unit decreases the rotating speed or shortens the temperature sensing cycle.

12. An air conditioner, comprising:

a temperature sensing unit to sense a temperature of an indoor space;

a rotating unit to rotate the temperature sensing unit; and a control unit to control the temperature sensing unit and the rotating unit, wherein the temperature sensing unit is a multi-channel heat sensor having a plurality of temperature sensing elements, and temperature sensing cycles of the temperature sensing unit corresponding to respective channels are predetermined differently.

13. A method of controlling an air conditioner, comprising:

sensing a distance to a target object within one of a plurality of rotating sections with a distance sensing unit;

determining whether a distance to the target object is greater than or less than a reference distance; and increasing a rotating speed of a temperature sensing unit with respect to a reference speed in the rotating section in which the target object resides when the distance to the target object is less than the reference distance or decreasing the rotating speed of the temperature sensing unit with respect to the reference speed in the rotating section in which the target object resides when the distance to the target object is greater than the reference distance.

14. A method of controlling an air conditioner, comprising:

sensing a distance to a target object within one of a plurality of rotating sections with a distance sensing unit;

determining whether a distance to the target object is greater than or less than a reference distance; and increasing a temperature sensing cycle of a temperature sensing unit with respect to a reference temperature sensing cycle in the rotating section in which the target object resides when the distance to the target object is less than the reference distance or decreasing the temperature sensing cycle of the temperature sensing unit with respect to the reference temperature sensing cycle in the rotating section in which the target object resides when the distance to the target object is greater than the reference distance.

* * * * *